US005992433A

United States Patent [19]

Chung-Kuang et al.

[11] Patent Number: 5,992,433

[45] Date of Patent: Nov. 30, 1999

[54] MULTIPLE-FOLD AUTOMATIC UMBRELLA WITH SIMPLIFIED CONTROL MECHANISM AND MINIMIZED ELEMENTS

[75] Inventors: Lin Chung-Kuang; Jung-Jen Chang, both of Taipei Hsien, Taiwan

[73] Assignee: Fu Tai Umbrella Works, Ltd., Taipei Hsien, Taiwan

[21] Appl. No.: 09/038,021

[22] Filed: Mar. 11, 1998

[51] Int. Cl.[6] ..... A47B 25/14

[52] U.S. Cl. ..... 135/24; 135/20.3; 135/22; 135/23; 135/25.1

[58] Field of Search ..... 135/20.3, 25.1, 135/25.4, 25.41, 22, 23, 24

[56] References Cited

U.S. PATENT DOCUMENTS 5,626,161 5/1997 Lin et al. ..... 135/24
5,823,214 10/1998 Siedel ..... 135/24 X
5,868,151 2/1999 Kuo ..... 135/24

*Primary Examiner*—Robert Canfield

[57] ABSTRACT

A multiple-fold automatic umbrella includes: a control device having a ring-shape push button slidably held in the grip having an upper latch integrally formed on a ring portion of the push button which is engaged with a slot formed in a lower runner slidably held on a central shaft of the umbrella for locking the runner and central shaft at their folded state, and which is disengaged from the slot of the runner for opening the umbrella when depressing the push button; and an elongated cylinder of an anti-false operation safety device resiliently held in the grip having a lower latch resiliently formed on a lower portion of the cylinder for preventing unexpected depression on the lower latch and only after the umbrella is opened, the lower latch may then be actuated, upon depression of the push button, for closing the umbrella from an opened umbrella, thereby providing an automatically opening and closing umbrella with simplified structure and minimized elements for the control device of the umbrella.

4 Claims, 4 Drawing Sheets

562
152
15
16
21
563
151
41
42
27
26
32
171a
3
22
4
25
2
24
23
564
171
231
230
14
56
17
1
172
13
561
560
552
55
A
11
B
120
120a
522
5
52a
51
551
54
12
53

51a
55
3
120
511a
120a
11
572
31
10a
522
124
51
581
52a
111a
50
583
5

571
54
B
540
573
551
12
A
582
57a
59
10
10
55
120a
11
120
511
5
124
52a
31
50
10a
511a
580
583
51
551
111a
58
540
12
54
57a
53
582
A
B
59

FIG. 5
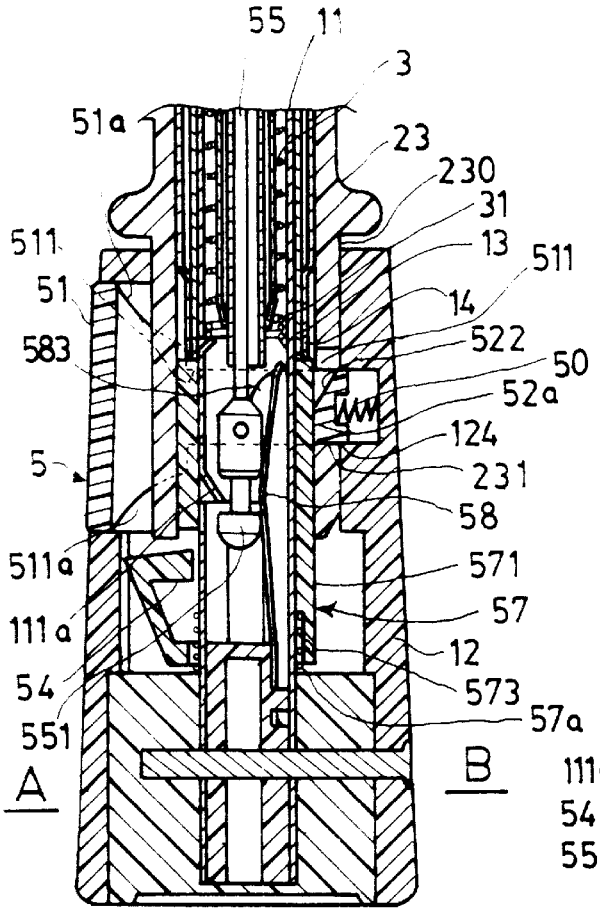
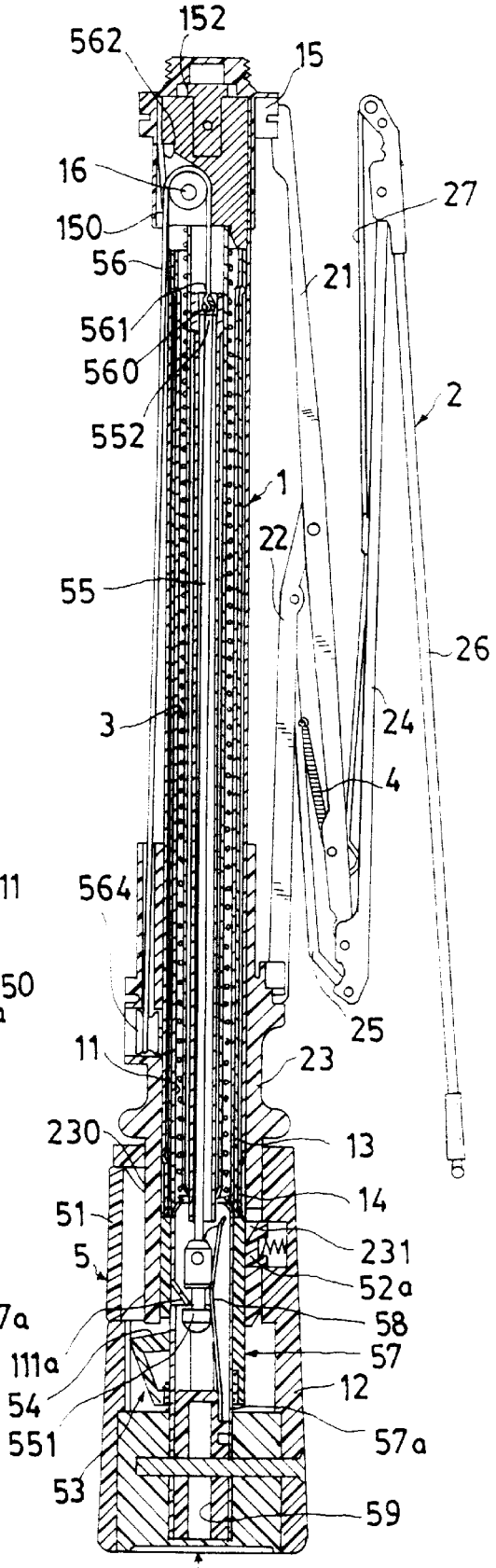
FIG. 4

MULTIPLE-FOLD AUTOMATIC UMBRELLA WITH SIMPLIFIED CONTROL MECHANISM AND MINIMIZED ELEMENTS

BACKGROUND OF THE INVENTION

This invention is a further improvement over the previously issued U.S. Pat. No. 5,626,161 (hereinafter called "prior art") also granted to the co-inventors of this application.

The prior art disclosed a multiple-fold automatic umbrella having a push button slidably held in the grip for controlling the opening and closing of the umbrella with simplified control means.

However, the control means (5) of the prior art can be further modified to further simplify its structure and minimize the elements in construction of the control means (5).

For instance, the upper latch (52) is separated from the push button (51) and may be integrally formed with the push button (51) for simplifying the structure and minimizing the parts of the control means (5). The lower latch (54) formed on the cylinder (571) of the anti-false operation safety means (57) is directly depressed by the middle and outer tubes (13,14) when folding the umbrella (FIG. 3 of the prior art) to be easily damaged by fatigue failure. The cylinder (571) may be elongated to allow a top surface of the cylinder to be positioned above the lower latch (54) to directly receive the outer and middle tubes (14,13) when closing the umbrella to prevent a direct compression upon the lower latch (54) for prolonging service life of the control means (5).

The present inventor has found the drawbacks of the prior art and invented the present automatic umbrella with simplified structure and minimized elements of the control means.

SUMMARY OF THE INVENTION

The object of the present invention is to provide a multiple-fold automatic umbrella including: a control device having a ring-shape push button slidably held in the grip having an upper latch integrally formed on a ring portion of the push button which is engaged with a slot formed in a lower runner slidably held on a central shaft of the umbrella for locking the runner and central shaft at their folded state, and which is disengaged from the slot of the runner for opening the umbrella when depressing the push button; and an elongated cylinder of an anti-false operation safety device resiliently held in the grip having a lower latch resiliently formed on a lower portion of the cylinder for preventing unexpected depression on the lower latch and only after the umbrella is opened, the lower latch may then be actuated, upon depression of the push button, for closing the umbrella from an opened umbrella, thereby providing an automatically opening and closing umbrella with simplified structure and minimized elements for the control device of the umbrella.

BRIEF DESCRIPTION OF THE DRAWINGS

FIG. 4 is a sectional drawing showing a folded (closed) umbrella of the present invention after re-setting the opening spring of the umbrella.

FIG. 5 is an enlarged view of the control means of the present invention of FIG. 4.

DETAILED DESCRIPTION

Figures 1, 2, 3:
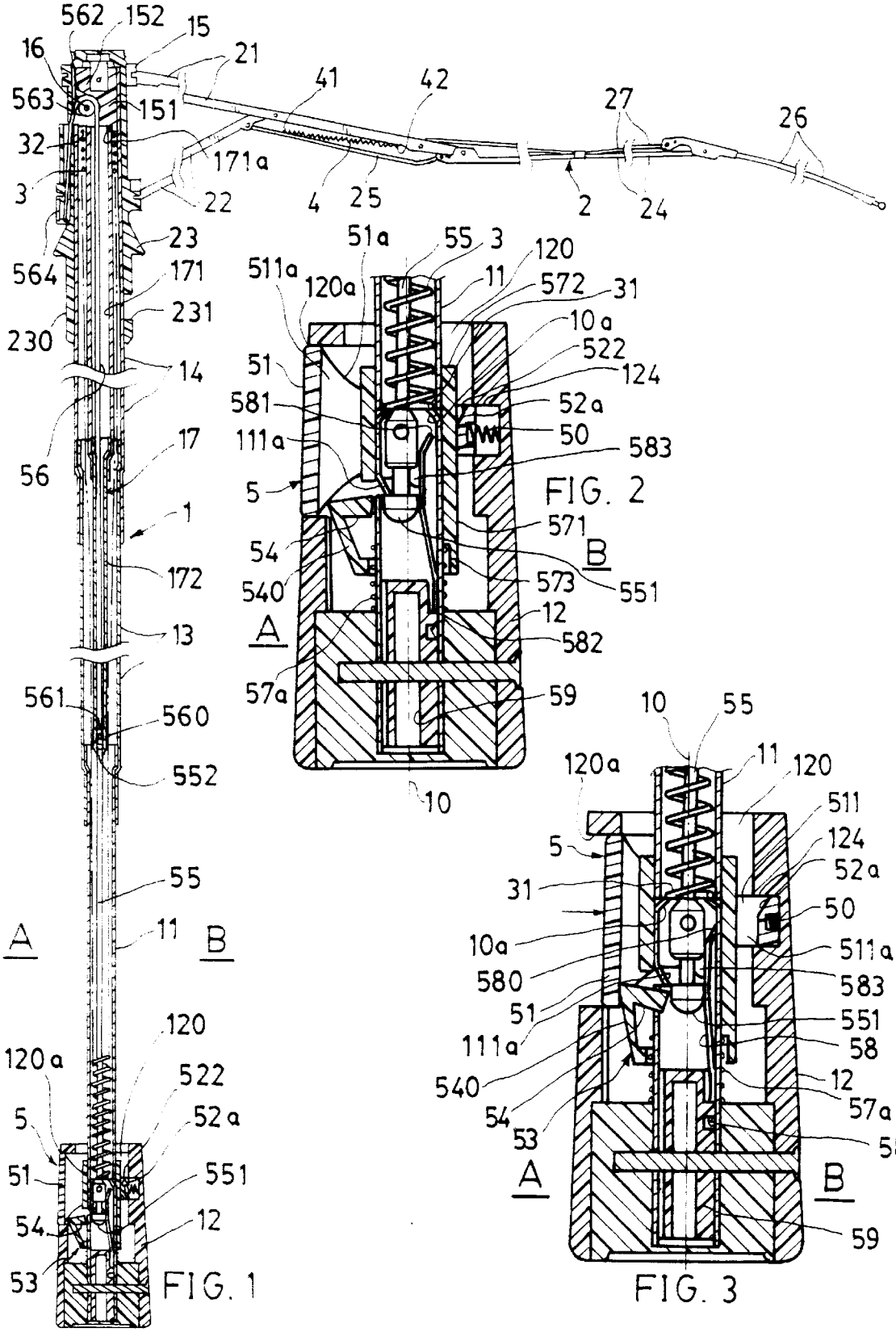
FIG. 1 shows an opened umbrella of the present invention.
FIG. 2 is an enlarged view showing the control means of the present invention of FIG. 1.
FIG. 3 is an illustration showing a depression of the push button from FIG. 2.

As shown in the drawing figures, the present invention comprises: a central shaft means 1, a rib assembly 2, an opening spring 3, a plurality of closing springs 4, and a control means 5. The elements and description of this application are mostly repeated from the prior art of U. S. Pat. No. 5,626,161.

The central shaft means 1 includes: an inner (or lower) tube 11, a grip 12 secured to a lower tube portion of the inner tube 11, a middle tube 13 slidably held on an outer find upper side of the inner tube 11, an outer (or upper) tube 14 slidably held on an outer and upper side of the middle tube 13, an upper notch 15 secured on a top portion of the outer tube 14, and a central sleeve set 17 including an inner sleeve section 372, and an outer sleeve section 171 telescopically coupled with the inner sleeve section 172 having an uppermost sleeve portion 171*a* of the outer sleeve section 171 contiguous to an upper portion of the outer tube 14.

The rib assembly 2 includes: a top rib 21 having an inner portion of the top rib 21 pivotally secured to the upper notch 15 of the central shaft means 1, an inner stretcher rib 22 having an inner portion of the inner stretcher rib 22 pivotally secured to a lower runner 23 which is slidably held on the outer tube 14 and having an outermost rib end of the inner stretcher rib 22 pivotally connected with a middle portion of the top rib 21, an intermediate rib 24 having an inner portion of the intermediate rib 24 pivotally connected with an outermost rib end of the top rib 21 and having an innermost rib end of the intermediate rib 24 pivotally connected with an intermediate connecting rod 25 of which an inner rod end of the intermediate connecting rod 25 is pivotally secured to an outer portion of the inner stretcher rib 22, and a rear rib 26 having an inner portion of the rear rib 26 pivotally connected with an outer portion of the intermediate rib 24 and having an innermost rib end of the rear rib 26 pivotally connected with a spring rod 27 of which an inner rod end of the spring rod 27 is pivotally connected with an outer portion of the top rib 21. Other mechanisms of the ribs can be modified. The lower runner 23 has a lower extension tube 230 protruding downwardly from the runner 23 having a slot 231 cut in the extension tube 230.

The opening spring 3 for opening an umbrella of this invention has a lower spring end 31 retained on a lower tube portion 10*a* of the inner tube 11, and an upper spring end 32 retained on a bottom portion of an inner block 151 inserted in an upper portion of the outer tube 14, the opening spring 3 slidably disposed about the central sleeve set 17.

Each closing spring 4 of the plurality of the closing springs 4 has an inner spring end 41 of the closing spring 4 secured to an inner portion of the intermediate connecting rod 25, and an outer spring end 42 of the closing spring 4 secured to an outer rib portion of the top rib 21. The closing spring 4 is provided for operatively closing an umbrella from its opened state by an elastic energy stored when opening the umbrella. The closing spring 4 may also be installed on the other locations of the rib assembly 2.

The control means 5 includes: a push button 51 resiliently held in a button hole 120*a* formed in the grip 12 having an upper latch 52*a* integrally formed on a ring portion 511 which is slidably held in at least a guiding groove 124 transversely recessed in an inside wall of the grip 12, with the ring portion 511 tapered from the push button 51 from a first side A of the central shaft 1 towards a second side B of the shaft 1 to form a pair of reinforced side-wing portions 51*a* disposed on opposite sides of the push button and each wing portion 51*a* defined between the push button and the ring portion 511, and having the upper latch 52*a* operatively actuated when simultaneously depressing the push button 51 for opening the umbrella, a closing controller 53 having a lower latch 54 resiliently secured on an anti-false operation safety means 57 resiliently held in the grip 12 and the lower latch 54 being operatively depressible by the push button 51 for inwardly pushing a locking head 551, which is secured with a drag rod 55 coupled to a drag rope 56 which is linked through the lower runner 23 to an upper portion of the outer tube 14, for disengaging the locking head 551 from a detent protrusion 111*a* formed in a lower portion of the inner tube 11, thereby allowing each said closing spring 4 to be restored to release its pre-stored elastic energy for closing the umbrella from an opened state, with the anti-false operation safety means 57 having an elongated cylinder 571 lowered by the outer and middle tubes 14, 13 when closing the umbrella to prevent a false depression of the closing controller 53 as depressed by the push button.

The upper latch 52*a* as integrally formed on the ring portion 511 of the push button 51 includes: a sloping latch portion 522, adjacent to the second side B of the shaft means 1, operatively depressed and retracted by the lower runner 23 when closing the umbrella, and the upper latch 52*a* having a spring socket 524 recessed in the ring portion 511 of the push button 51 adjacent to the second side B of the shaft means 1 to be resiliently urged towards the first side A of the shaft means 1 by a restoring spring 50 retained in the grip 12 adjacent to the second side B of the shaft means 1 to be engageable with the slot 231 formed in the lower runner 23 for locking the umbrella at its folded state (FIG. 4).

The push button 51 has the ring portion 5111 formed with a central hole 511*a* in a central portion of the ring portion 511 for downwardly passing the lower extension tube 230 of the lower runner 23 which is disposed around a bottom tube portion of each outer tube 14 and middle tube 13 when folding the central shaft means 1 for closing the umbrella (FIG. 4). The sloping latch portion 522 is tapered downwardly from an upper rim surface of the ring portion towards the centrol hole 511*a* to be thrusted or retracted when lowering the runner 23 for closing the umbrella. The restoring spring 50 will then urge the upper latch 52*a* for engaging the slot 231 in the runner 23 for locking the umbrella at its folded or closed state.

Upon an inward depression of the push button 51 to retract the upper latch 52*a* for disengaging the upper latch 52*a* from the slot 231 of the lower runner 23, the umbrella will be opened because the tubes of the shaft means 1 and the lower runner 23 are resiliently tensioned by the opening spring 3.

The closing controller 53 includes: the lower latch 54 resiliently secured to a lower portion of an elongated cylinder 571 of the anti-false operation safety means 57 by a spring plate 540, with the elongated cylinder 571 resiliently raised upwardly as urged by a tension spring 57*a* which is retained in a bottom spring socket 573 recessed in a bottom of the cylinder 571 to position the lower latch 54 in between the push button 51 and a locking head 551 secured with the drag rod 55 when opening the umbrella as shown in FIG. 1, with the central hole 511*a* in the ring portion 511 allowing an upwardly moving of the cylinder 571 and the lower latch 54 because the cylinder 571 is urged by the tension spring 57*a* after opening the umbrella to extend the outer and middle tubes 14, 13 upwardly and raise the runner 23 as shown in FIGS. 1 & 2, whereby upon depression of the push button to inwardly push the lower latch 54 and the locking head 551 through a latch hole formed in the inner tube 11, the locking head 551 will be disengaged from the detent protrusion 111*a* in the inner tube 11 for closing an umbrella from an opened state.

The detent protrusion 111*a* is directly punched inwardly from a lower portion of the inner tube 11 for engaging the locking head 551 when closing the umbrella as sidewards biased towards the first side A of the shaft means 1 by a convex spring plate 58 formed in the grip 12 at the second side B of shaft means 1.

The drag rod 55 has a lower rod end secured to the locking head 551 and an upper rod end 552 coupled to an inner rope end 561 of the drag rope 56 through a coupling sleeve 560, with the drag rod 55 slidably held in the inner sleeve section 172 of the central sleeve set 17.

The drag rope 56 includes: the lower rope end 561 coupled to the drag rod 55 by the coupling sleeve 560, an upper rope end 562 fixed to a top portion 152 of the outer tube 14 and in the upper notch 15, an upper guiding roller 563 rotatably mounted by an upper pivot 16 in the inner block 151 secured in a top portion of the outer tube 14 and in the upper notch 15 for slidably guiding the drag rope 56 from inside the outer tube 14 and the central sleeve set 17 telescopically held within the inner tube 11, the middle tube 13, and the outer tube 14 through the upper guiding roller 563 towards a lower guiding roller 564 through a rope passage 150 formed in the upper notch 15, the rope 56 having an upper rope section passing through the lower guiding roller 564 by deflectively winding the rope on the lower guiding roller 564 and then extending the rope upwardly to have the upper rope end 562 fixed to the top portion 152 of the outer tube 14 and inside the inner block 151.

Figure 7:
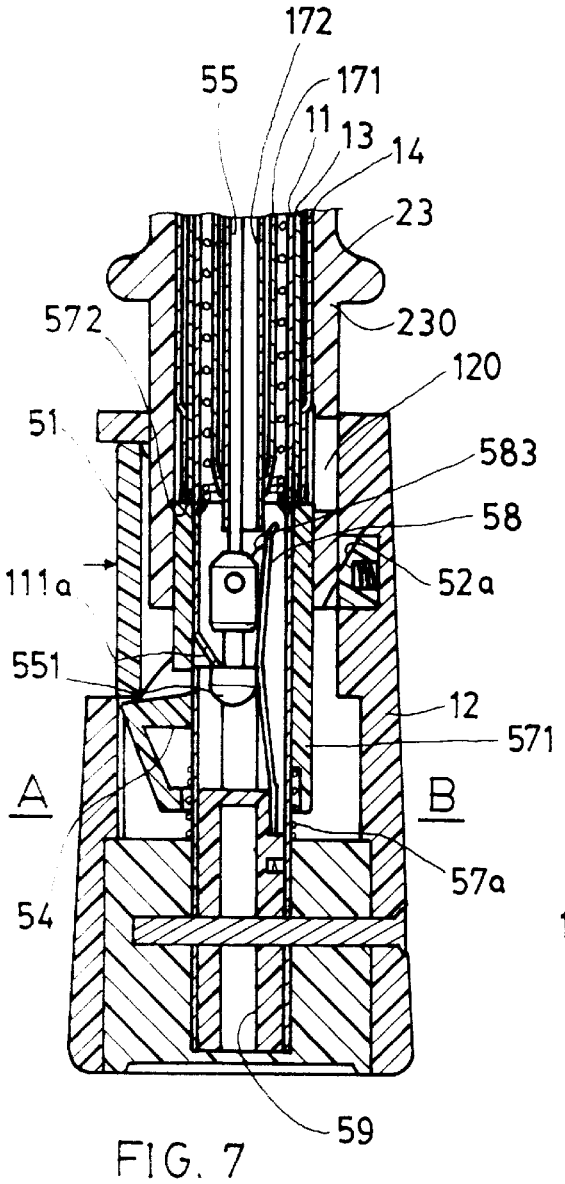
FIG. 7 is an enlarged view of the control means as shown in FIG. 6.
Figure 6:
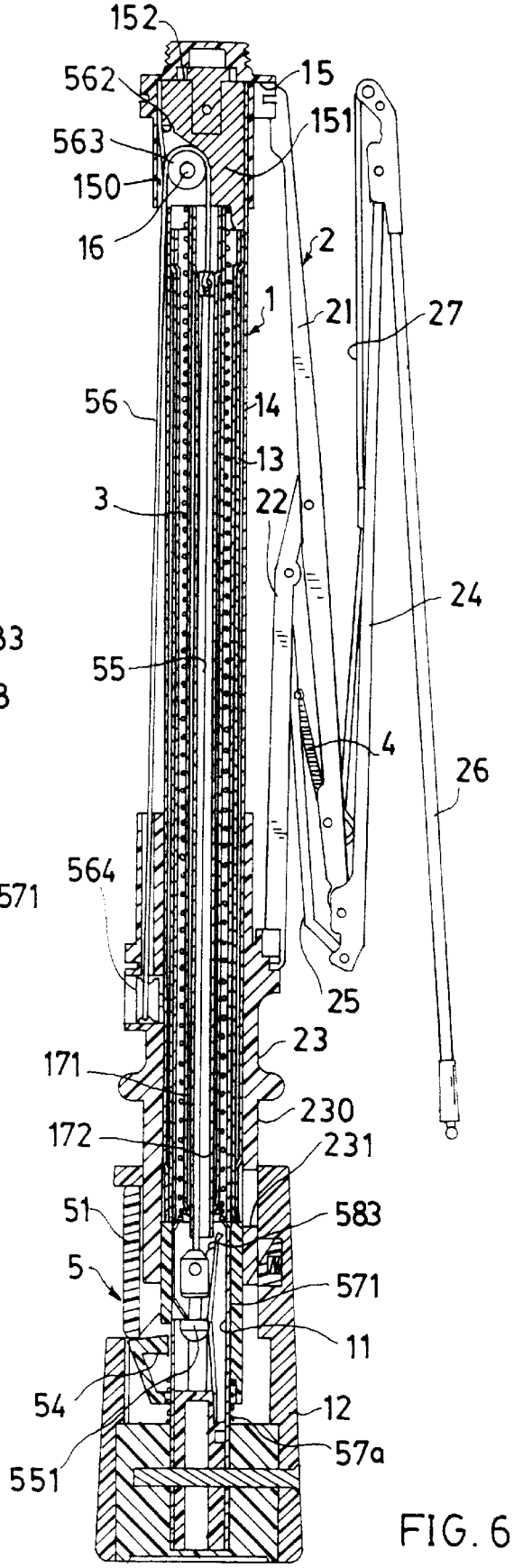
FIG. 6 is an illustration of the present invention for preventing false operation of the closing controller.
Figures 8, 9:
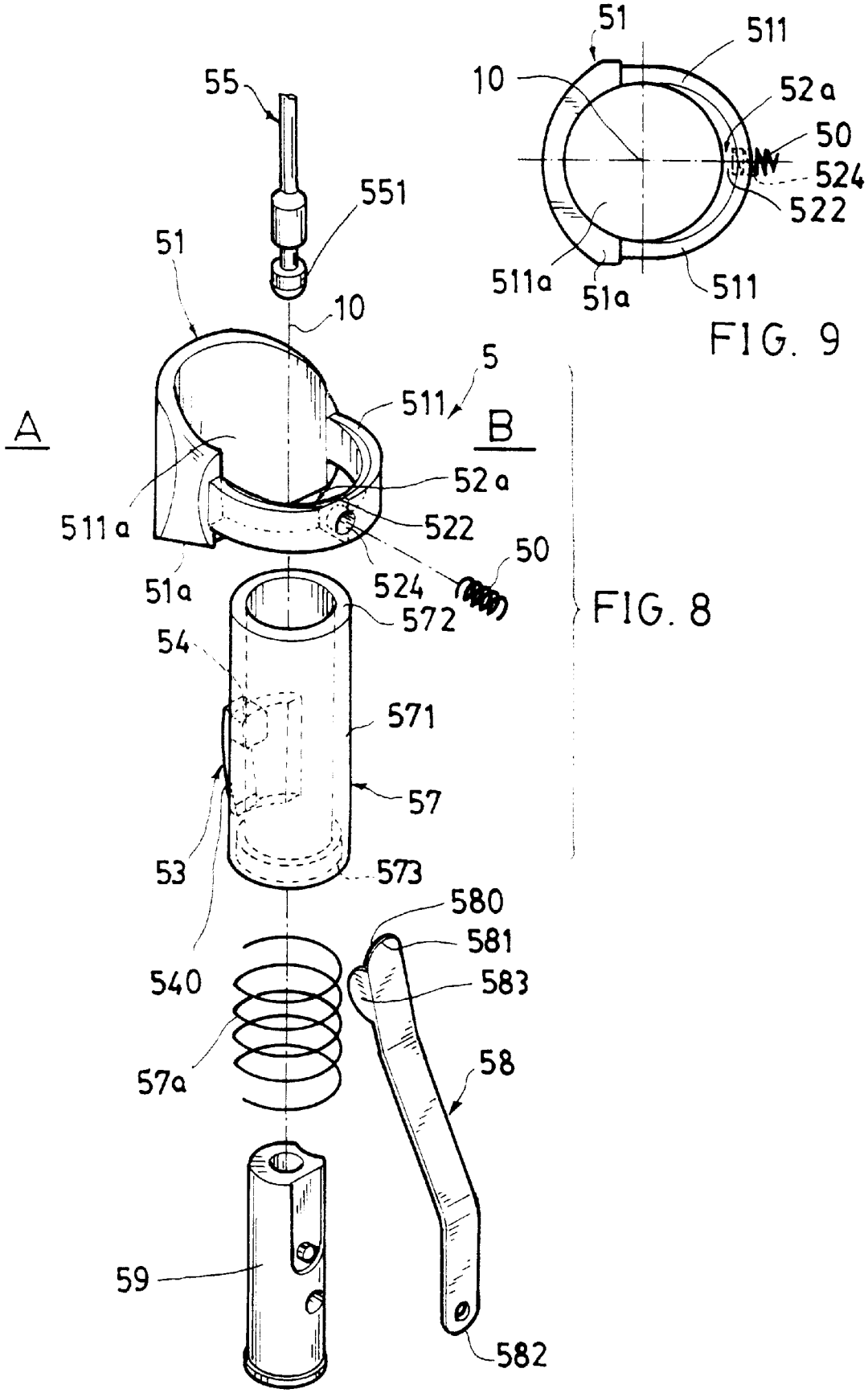
FIG. 8 is an exploded view of the control means of the present invention.
FIG. 9 is a top view of the ring-shape push button of the present invention.

The anti-false operation safety means 57 includes: an elongated cylinder 571 slidably disposed around a lower portion of the inner tube 11 and resiliently rested on a tension spring 57*a* retained in a lower portion of the grip 12, the cylinder 571 having the lower latch 54 integrally formed on or secured to a lower portion of the cylinder 571 by a spring plate 540, whereby when closing the umbrella, the lower runner 23 is lowered to insert the extension tube 230 into the inner hole 120 of the grip and the central shaft means 1 is folded to lower the outer and middle tubes 14, 13 to allow a bottom end of each middle tube 13 and outer tube 14 to downwardly press an annular top surface 572 of the cylinder 571 downwardly for compressing and restoring the spring energy of the tension spring 57*a* as shown in FIGS. 4, 5, whereby the runner 23 is locked by engaging the upper latch 52*a* with the slot 231 of the runner 23, and the lower latch 54 connected to the cylinder 571 is lowered to be positioned under the push button 51 as shown in FIGS. 4, 5 without being depressed by the push button. Therefore, upon repression of the push button 51 as shown in FIGS. 6, 7 in order to open the umbrella, the lower latch 54 is positioned under and obstructed by the push button 51 to prevent unexpected actuation of the lower latch 54 of the closing controller 53 for preventing a false operation of the closing controller 53. When the push button 51 is restored from FIG. 7 to FIG. 2, the push button 51 may then be further depressed to actuate the lower latch 54 to close the umbrella as shown in FIG. 3.

The thickness of the annular top surface 572 of the cylinder 571 should be slightly larger than the total thickness of a bottom end of each middle and outer tube 13, 14 for resting the tubes 13, 14 on the top surface 572.

The convex spring plate 58 has a lower spring end 582 fixed to a plug 59 inserted in a bottom portion of the inner tube 11, a sloping spring portion 580 inclined downwardly from an upper spring end 581 to an axis 10 of the shaft means 1 for biasing the locking head 551 to be locked on the detent protrusion 111*a* formed in the inner tube 11 adjacent to the first side A of the shaft means 1 when closing the umbrella (FIGS. 4). Two flaps 583 are disposed on opposite side portions of the spring plate 58 for slidably holding the locking head 551 during the operation.

When opening the umbrella of the present invention as shown from FIG. 4 to FIG. 1, the push button 51 is depressed to disengage the upper latch 52*a* from the slot 231 formed in the runner 23 to release the opening spring 3, which is previously compressed when re-setting the umbrella for storing the elastic energy of the opening spring as shown in FIG. 4, to extend the tubes 14, 13, 11 and raise the runner 23 and open the ribs of the rib assembly 2 for opening the umbrella. The closing springs 4 are also tensioned to store their restoring elastic energy by the opening operation of the umbrella as effected by the opening spring 3.

When closing the umbrella from FIG. 1 to FIG. 4, the push button 51 is depressed to force the lower latch 54 of the closing controller 53 towards the second side B of shaft means 1 to disengage the locking head 551 from the detent protrusion 111*a* formed in the inner tube 11 to allow a downward movement of the runner 23 required for closing the umbrella, and the closing springs 4 will restore to lower the runner 23 to retract the ribs of the rib assembly 2 and fold the tubes 14, 13, 11. The lower latch 54 and the cylinder 571 will be moved upwardly as upwardly urged by the tension spring 57*a* to be positioned between the push button 51 and the locking head 551 after opening the umbrella and raising the tubes 14, 13 (FIG. 1), thereby causing no obstruction for the inward depression of the push button 51 ready for a normal closing operation of the umbrella (from FIG. 3 to FIG. 4).

For re-setting the folded or closed umbrella to store an elastic energy of the opening spring 3, the grip 12 may be depressed towards a tip portion of the umbrella for compressing the spring 3 ready for next opening use. In FIG. 4, the umbrella has already been reset by compressing tile spring 3 ready for next opening operation. The cylinder (571) and the lower latch (54) is lowered below the push button (51), while the lower extension tube (230) of the lower runner (23) is disposed around an upper portion of the cylinder (571).

The present invention is superior to U.S. Pat. No. 5,626,161 with the following advantages:

1. The lower latch 54 has been lowered its height to be secured to a lower portion of the elongated cylinder 571; and the middle tube 13 and the outer tube 14 are directly rested upon the top surface 572 of the cylinder 571 without acting upon the lower latch 54 for preventing damage of the lower latch.
2. The push button 51 is integrally formed with the upper latch 52*a* for simplying the structure and minimizing the elements of the control means 5.
3. The runner 23 is formed with the slot 231 for engaging the upper latch 52*a* for locking the umbrella at its folded state for eliminating two latch holes respectively formed in each lower tube portion of the middle and outer tubes 13, 14.
4. The simplified structure and minimized elements for making the umbrella will decrease the production cost, reduce the maintenance problems and prolong the service life of the umbrella.

The present invention may be modified without departing from the spirit and scope of this invention.

We claim:

1. An automatic umbrella comprising:

a central shaft means (1) including: an inner tube (11), a grip (12) secured with the inner tube (11), a middle tube (13) slidably held on an outer and upper side of the inner tube (11), an outer tube (14) slidably held on an outer and upper side of the middle tube (13), an upper notch (15) secured on a top portion of the outer tube (14), and a central sleeve set (17) having an inner and outer sleeve section (172,171) telescopically held within said inner, middle and outer tubes (11,13,14); a rib assembly (2) including a plurality of ribs pivotally connected with one another and pivotally secured between the upper notch (15) and a lower runner (23) slidably held on said central shaft means (1);

an opening spring (3) for opening an umbrella retained in said central shaft means (1) and slidably disposed about the central sleeve set (17);

a plurality of closing springs (4) respectively secured on said rib assembly (2) for operatively closing the umbrella from an opened state by an elastic energy stored when opening the umbrella; and a control means (5) including: a push button (51) resiliently held in the grip (12), an upper latch (52*a*) slidably held in said grip (12) and operatively actuated by the push button (51) for opening the umbrella, a closing controller (53) having a lower latch (54) resiliently secured to an anti-false operation safety means (57) resiliently held in the grip (12) and operatively depressible by the push button (51) for inwardly pushing a locking head (551), which is secured with a drag rod (55) coupled to a drag rope (56) which is linked through the lower runner (23) to an upper portion of the outer tube (14), for disengaging the locking head (551) from a detent protrusion (111*a*) formed in a lower portion of the inner tube (11), thereby allowing each said closing spring (4) to be restored to release a pre-stored elastic energy for closing the umbrella from an opened state, with said anti-false operation safety means (57) operatively lowered when closing the umbrella to prevent a false depression of the closing controller (53) as depressed by the push button (51);

the improvement which comprises:

said anti-false operation safety means (57) including an elongated cylinder (571) retained on a tension spring (57*a*) fixed in a lower portion in the grip (12), an annular top surface (572) formed on a top end portion of the cylinder (571) adapted for resting thereon a bottom end of each said middle tube (13) and said outer tube (14) for lowering the cylinder (571) when folding the umbrella, and said lower latch (54) resiliently secured to a lower portion of the cylinder (571) and operatively positioned under the push button (51) when the cylinder (571) is lowered when folding and closing the umbrella, thereby preventing depression on said lower latch (54) by the push button (51) and preventing false operation of the closing controller (53); and said push button (51) including a ring portion (511) protruding from said button (51) from a first side (A) of said shaft (1) towards a second side (B) of said shaft and defining a central hole **(511*a*) in a central portion of the push button (51) and the ring portion (511) for passing therethrough a lower extension tube (230) protruding downwardly from the lower runner (23) when closing the umbrella, said upper latch (52*a*) integrally formed on the ring portion (511) adjacent to the second side (B) of the shaft (1) for engaging a slot (231) formed in said lower extension tube (230) of said lower runner (23) for locking the umbrella at a folded state, said upper latch (52*a*) having a sloping latch portion (522) tapered downwardly from an upper rim surface of said ring portion (511) towards the central hole (511*a*) of said push button (51) to be depressed and retracted by said lower runner (23) when lowered for closing the umbrella, and a restoring spring (50) retained in the grip (12) adjacent to the second side (B) of the shaft (1) and protruding into a spring socket (524) in said ring portion (511) for normally urging said upper latch (52*a*) towards the first side (A) of the shaft for engaging the slot (231) of the lower runner (23)** for locking the umbrella as folded.

2. An automatic umbrella according to claim 1, wherein said push button (51) is tapered towards said ring portion (511) to form a pair of reinforced wing portions **(51*a*) on opposite sides of said push button (51), each said reinforced wing portion (51*a*) defined between said push button (51) and said ring portion (511)**.

3. An automatic umbrella according to claim 1, wherein said annular top surface (572) of said elongated cylinder (571) has a thickness slightly larger than a total thickness of a bottom end of each said middle tube (13) and said outer tube (14).

4. An automatic umbrella according to claim 1, wherein said lower extension tube (230) of said lower runner (23) is disposed around an upper portion of the elongated cylinder (571) of the anti-false operation safety means (57) when closing the umbrella.

* * * * *